US005188165A

United States Patent [19]

Ivansson

[11] Patent Number: 5,188,165

[45] Date of Patent: Feb. 23, 1993

[54] METHOD AND DEVICE FOR PRESSURE DIE CASTING

[75] Inventor: Hans Ivansson, Herrljunga, Sweden

[73] Assignee: Tour & Andersson AB, Sweden

[21] Appl. No.: 623,758

[22] PCT Filed: Jun. 12, 1989

[86] PCT No.: PCT/SE89/00331

§ 371 Date: Dec. 12, 1990

§ 102(e) Date: Dec. 12, 1990

[87] PCT Pub. No.: WO89/12518

PCT Pub. Date: Dec. 28, 1989

[30] Foreign Application Priority Data

Jun. 13, 1988 [SE] Sweden ..... 8802190

[51] Int. Cl.[5] ..... B22D 17/12

[52] U.S. Cl. ..... 164/113; 164/312; 164/347

[58] Field of Search ..... 164/312, 313, 314, 315, 164/344, 347, 401, 113

[56] References Cited

U.S. PATENT DOCUMENTS 3,038,220 6/1962 Saives ..... 164/313
3,443,628 5/1969 Carr ..... 164/313
4,601,321 7/1986 Tokui et al. ..... 164/313

FOREIGN PATENT DOCUMENTS 55-16772 2/1980 Japan ..... 164/313

*Primary Examiner*—Richard K. Seidel
*Attorney, Agent, or Firm*—Davis, Bujold & Streck

[57] ABSTRACT

A method and apparatus for die casting comprising a stationary lower machine table (5) provided with a stationary lower mold part (24) which cooperates with a vertically moveable upper mold part (22) mounted on an upper machine table (10) and displaceable by hydraulic cylinders (7). The upper machine table (10) and the upper mold part are provided with a filling chamber (20) for receiving a measured quantity of a molten metal which is to be pressed into the mold by an upper piston (18). A lower piston (43) is moved to a variable position relative to the filling chamber, prior to the molten metal filling, and thereafter the upper piston (18) is moved into contact with a top surface of molten metal, without any air-entrapment or with only a minor entrapment of air. After this has occurred, the upper piston and the lower piston are displaced jointly downward until the lower piston is in a casting position in the lower mold part, whereupon the upper piston is displaced further downward to feed the molten metal and maintain pressure of the molten metal until the casting operation is completed. The cylinder casing (38) of the lower piston is rigidly connected to a mechanism (29–37) designed to eject the casting produced.

20 Claims, 3 Drawing Sheets

METHOD AND DEVICE FOR PRESSURE DIE CASTING

The present invention relates to a method of die casting of the type set forth in more detail below. Also, the invention relates to a device used in die casting according to the first claim, which relates to a device.

In order to rationally utilize the capacity of a die casting machine it is often used to cast different objects. In order to cast such objects, i.e. in order to pass from the casting of a certain object type to another such object type, the lower as well as the upper piston and also the tube-shaped filling chamber usually are exchanged and of course also the mold and the tube, which surrounds the lower piston. Of course, this is always a time-consuming and expensive procedure, which is something objectionable. Also, the casting procedure is obstructed in this way, since e.g. constantly altered diameters of casting pistons, used at the moment, result in fluctuating pressures, which usually are not acceptable or even attainable. Consequently, an alteration of the casting piston diameter, i.e. a casting piston exchange, has to be accompanyed by a corresponding alteration of the pressing pressure of the machine. This leads automatically to a great risk, that personnel will make miscalculations or misadjustments as regards the pressure, a quality deterioration or even a rejection of castings produced resulting. Also, undesirable air entrapments can not always be positively avoided in the known die casting machines.

The object of the present invention is to improve and develop the known die casting methods and devices in the above-mentioned respects. Also, another object is to contribute to the advancement of the art in this field in various respects and create opportunities for a rational technique and products having a satisfactory and uniform quality.

These objects are attained by the method and apparatus more clearly set forth in the following description and appended drawings.

Figure 1:
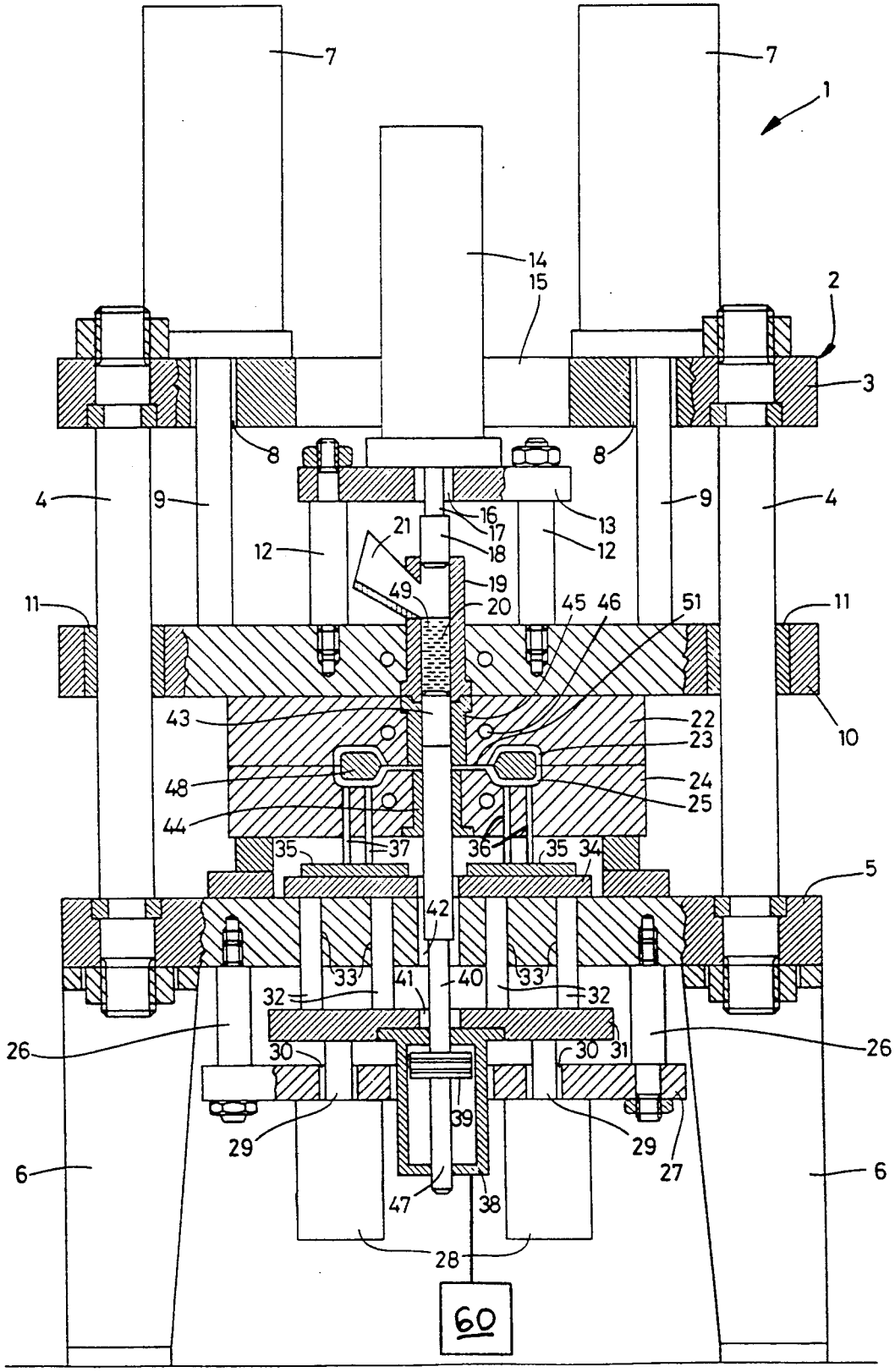
Figure 2:
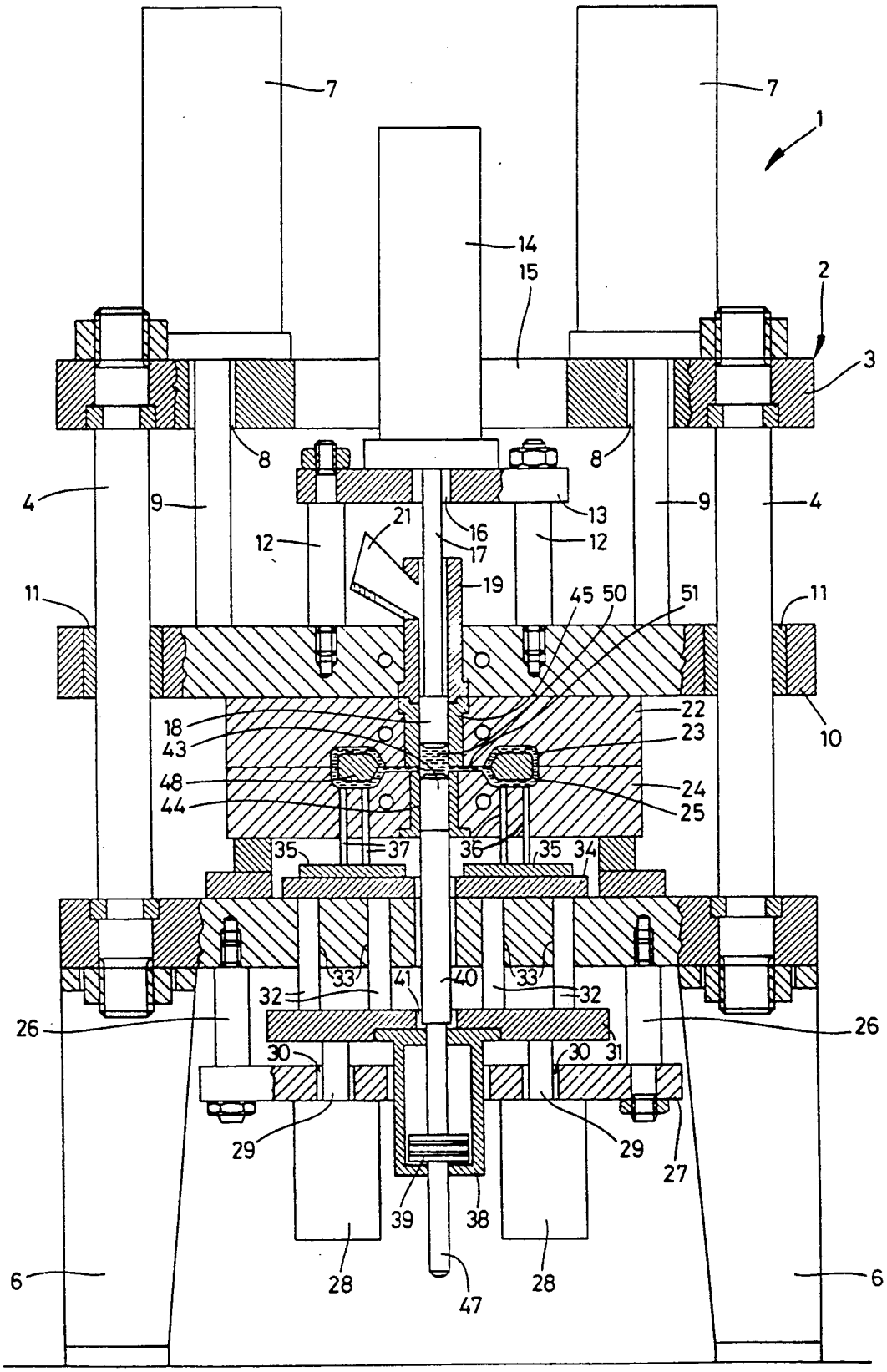
Figure 3:
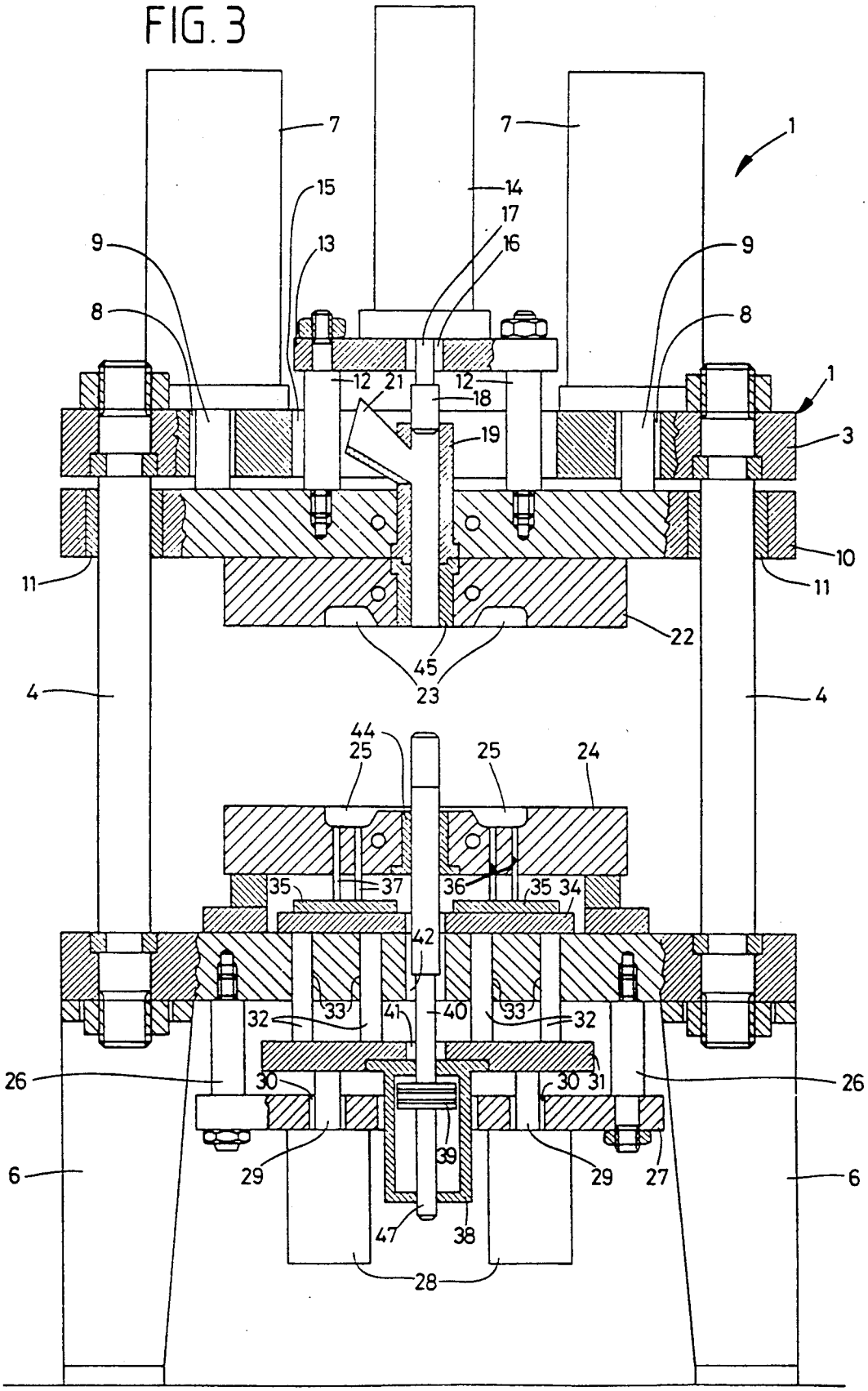

Additional characterizing features and advantages of the present invention are set forth in the following description, reference being made to the accompanying drawings, which partially schematicly show an embodiment, which is not limiting, of a die casting device according to the invention, and in which:

FIG. 1 shows a device according to the invention in its casting position, i.e. after a closing of the molds and a filling of liquid metal but before the casting itself; FIG. 2 shows the device according to FIG. 1 after the completed casting; and FIG. 3 shows the device according to FIG. 1 after the discharge of the castings produced, being prepared to return to the starting position for the next casting cycle.

In the drawings a device 1 according to the invention, shown in its entirety, comprises a machine frame 2, which mainly comprises an upper base plate 3, from which four machine bearers 4 project downwards, the lower ends of which support a lower machine table 5, which is supported by feet 6.

Upper base plate 3 supports four hydraulic form cylinders 7, designed to open and close a mold, which is described in the following text, by means of a control system, known per se (not shown). Piston rods 9 project from form cylinders 7 downwards through bores 8 in the base plate, and an upper machine table 10 is suspended from the lower ends of said piston rods and is displaceable along machine bearers 4 by means of guide bushings 11.

A yoke 13 is positioned above upper machine table 10 by means of spacing rods 12, at a distance from and preferably centered above this machine table. Yoke 13 supports an upper piston cylinder 14, which projects upwards through an opening 15 in the base plate, which opening is wide enough to allow also the yoke in its position according to FIG. 3 to pass.

A piston rod 17 projects downwards through an opening 16 in yoke 13 and is provided with an upper piston 18, which is inserted into a tube 19, which is fastened to upper machine table 10, encloses a filling chamber 20 and is provided with a filling funnel 21, designed to introduce a certain measured amount of liquid metal.

An upper mold part 22 is fastened to the underside of the upper machine table, and its underside is in its turn provided with an upper cavity 23.

A lower form part 24 is supported on machine table 5 and its upside is provided, in an analogous manner, with a lower cavity 25.

A holding plate 27 is mounted below machine table 5 through spacing rods 26, at a distance from the same, for ejector cylinders 28, mounted below the holding plate. Their piston rods 29 extend upwards through openings 30 in holding plate 27 to jointly support a bridge 31, which is mounted to be displaceable between machine table 5 and holding plate 27. Bridge 31 supports in turn 2–12 ejector rods 32, which extend upwards through bores 33 in machine table 5 in order to, above the latter, support a common connecting plate 34 having upper ejector plates 35 and ejector pins 37, which are inserted from said ejector plates into lower mold part 24 in control holes 36 in the latter, by means of which ejector pins the castings, after the completed casting operation, can be ejected, when the mold has been opened up.

A lower piston cylinder 38 is mounted below bridge 31 in a central position, in which cylinder a piston 39 is mounted, from which a piston rod 40 issues, which extends through openings 41 and 42 respectively in bridge 31 and machine table 5 respectively, in order to, in its free ends support a lower piston 43, which is guided in a bushing 44 in the lower mold part and in bushing 45, designed as a continuation of bushing 44, in the upper mold part. Also, tube 19 and bushing 45 can be designed as a unit. Also, said bushings can be cooled directly or indirectly in a way known per se, not shown in great detail in this context. However, cooling ducts are jointly indicated through reference numeral 46 in FIG. 1.

Lower piston 43 and piston rod 40 suitably are cooled, too, and in that case a connection 47 from piston 39 to a cooling equipment, not shown, can extend downwards through cylinder 38.

The device, described in this way, can be used as follows: FIG. 1 shows, as has been mentioned, the device in its casting position, the molds being closed, e.g. with an enclosed mold insert 48. A certain measured amount of liquid metal, preferably being a non-iron-alloy, has already been filled into chamber 20 and is designated 49. The surface of the filled metal suitably reaches the lower edge of funnel 21 or possibly a small distance below the same, provided a very small required amount of air is to be enclosed between the upper piston and the metal during the following casting operation. In order to attain this precise adjustment one has to pay attention to the measured amount of metal as well as, and this is most important, the position of the lower piston, which according to the invention is adjustable in a required elevation position, in order to allow an exact calculatable filling of metal, and an optimal carrying out of the casting operation, with the least possible excess amount. The position of the lower piston is adjusted and indicated in a suitable way, e.g. through a programmable electronically operated display panel 60.

The upper piston is then lowered to immediately above the metal surface, in which position the device is programmed in such a way, that the upper piston and the lower piston start a joint movement downwards, until the lower piston has reached a position according to FIG. 2, in which the lower piston stops, i.e. immediately below feeding ducts 1 between the mold parts. The speeds of the pistons during the movement now described preferably are the same. When the lower piston has stopped, the upper piston moves further downwards to a position according to FIG. 2 in order to bring forward all of the filled amount of metal and press the same into the entire mold, a certain excess amount, a so called pressing briquette 50, remaining in the lowest portion of the filling chamber.

When the metal has solidified in the mold, after e.g. 2–20 seconds, form cylinders 7 are activated and piston rods 9 will then pull upper machine table 10 upwards with upper mold part 22 and the upside of the casting will be exposed. In order to completely remove briquette 50 from filling chamber 20 upper piston cylinder 14 is kept active and consequently, it will push the piston rod outwards successively, when machine table 5 is moved upwards, the upper piston all the time being pressed against the briquette, until the upper machine table has reached its upper starting position according to FIG. 3, in which the upper piston cylinder is activated to pull the piston into the position shown in FIG. 3. Of course, piston rod 17 can be pulled inwards somewhat earlier, e.g. as soon as a relative position has been reached, in which the briquette has left the filling chamber.

Cylinders 28 are now activated and bridge 31 is lifted and finally ejector pins 37 are activated as a result, the castings produced being completely set free, also from the lower mold part. The lower piston contributes to this also, since its cylinder is fastened to the bridge, which results in that also the lower piston besides the ejector pins are displaced in relation to the lower mold part. When cylinders 28 have returned to their starting position according to FIG. 1, cylinder 38 is activated and its piston 39 lifts the lower piston to a position according to FIG. 3, which is the same as the position shown in FIG. 1, and in this way a new casting cycle can be initiated.

The free end surface of the lower piston and preferably also its envelope surface are, according to a preferred embodiment of the invention, provided with a ceramic coating in order to stop a wear and/or provide a heat insulator to a limited degree. The wall of the filling chamber can also be made of a ceramic material. In this way the metal will be cooled to a minimum in the filling chamber, which is desirable, while the thermal expansion of tube 19 and the lower piston respectively also is comparatively limited, which is desirable in order to maintain the required limits. Also, the upper piston can be cooled in order to attain a faster solidification, and its envelope surface can, in order to prevent a wear, be provided with a ceramic coating.

In order to obtain the best possible casting quality the present invention, with all its characterizing features, strives to achieve a consistent control of the solidification from the outside and inwards, e.g. briquette 50 in this connection being kept as hot as possible at its underside and at the lateral sides, while a cooling and then also a solidification from the upside is facilitated. The underside or the free end surface of the upper piston can also be made of a material having a satisfactory thermal expansion coefficient, e.g. molybdenum alloys and particularly such an alloy with the brand name of TZM.

While the transition period from one casting type to another is 3–4 h in a conventional casting machine, we have found that the corresponding transition period in a device or machine according to the present invention can be as short as 10–15 minutes. Thus, important time-savings and method improvement gains are made possible in accordance with the present invention.

I claim:

1. A method of die casting an article in an apparatus having a lower piston (43) guided by a stationary lower mold part (24), a upper machine table (10) with an upper mold part (22), cooperating with the lower mold part (24), mounted on a bottom surface thereof moveable vertically relative to the lower mold part (24), a filling chamber (20) carried by the upper mold part for containing a desired quantity of molten metal (49), the lower piston (43), when engaged with the filling chamber, forming a base portion of the filling chamber for temporarily supporting the molten metal, said method comprising the steps of:

moving the lower piston (43) relative to the filling chamber to a variable initial starting position prior to supplying the molten metal to the filling chamber, the variable initial starting position of the lower piston (43) being selected so that the quantity of molten metal to be contained within the filling chamber is equivalent to a contemplated casting plus a required excess amount, after supplying the molten metal to the filling chamber, moving an upper piston (18) into contact with a top surface of the molten metal, without any substantial air-entrapment in the filling chamber, for pressure feeding the molten metal into the mold (22, 24), displaying jointly the lower piston, the molten metal and the upper piston vertically downward until the molten metal is in communication with the feeding duct, stopping further downward motion of the lower piston, upon the molten metal communicating with the feeding duct, while continuing further downward motion of the upper piston to pressure feed the molten metal into the mold parts and subject the molten metal to continued pressure until the casting operation is completed, and ejecting the cast article from at least one of the mold parts by an ejector mechanism (29–37).

2. A method according to claim 1, further comprising the step of indicating the initial starting position of the lower piston position electronically with a display panel.

3. A method according to claim 1, further comprising the step of, after the molten metal has solidified in the mold (22, 24), moving the upper mold part vertically upward away from the lower mold part to expose the cast article and maintaining pressure on a briquette (50) which formed in the filling chamber (20) during this vertical upward movement so that the briquette exits the filling chamber.

4. A method according to claim 3, further comprising the step of moving the upper piston to its starting position for a new casting cycle after the briquette exits the filling chamber.

5. A method according to claim 1, further comprising the step of moving the lower piston, after ejecting the cast article from the mold, to a desired initial starting position for a new casting cycle.

6. A method according to claim 1, further comprising the step of heat insulating at least one of the inner wall of the filling chamber (20) and at least a portion of the lower piston (43).

7. A method according to claim 6, further comprising the step of using a ceramic coating for the heat insulating.

8. A method according to claim 1, further comprising the step of using a ceramic coating for heat insulating.

9. A method according to claim 8, further comprising the step of using a molybdenum alloy for making at least a free end surface of the upper piston heat conductive.

10. A device for die casting comprising a stationary lower machine table (5) having a stationary lower mold part (24) on an upper surface thereof, an upper mold part (22), cooperating with the lower mold part, mounted on a lower surface of an upper machine table (10), the upper mold part and the upper machine table being vertically movable relative to the lower mold part by hydraulic cylinders (7) connected to support means, the upper machine table and the upper mold part jointly forming a filling chamber (20) for receiving molten metal to be cast, a hydraulic actuated upper piston (18) attached to the support means to facilitate casting of the molten metal into the cooperating mold parts, and a hydraulic actuated lower piston (43), guided by the lower mold part, for temporarily supporting the molten metal, and the lower piston (43) cooperating with the upper piston (18) to facilitate casting of the molten metal, wherein said device further includes means for moving the lower piston (43) relative to the filling chamber to a variable initial starting position prior to supplying the molten metal to the filling chamber, the variable initial starting position of the lower piston (43) being selected so that the quantity of molten metal to be contained within the filling chamber is equivalent to a contemplated casting plus a required excess amount, means for moving an upper piston (18) into contact with a top surface of the molten metal, after supplying the molten metal to the filling chamber, without any substantial air-entrapment in the filling chamber for pressure feeding the molten metal into the mold parts (22, 24), means for jointly displacing the lower piston, the molten metal and the upper piston vertically downward until the molten metal is in communication with the feeding duct, means for stopping further downward motion of the lower piston, upon the molten metal communicating with the feeding duct, while continuing further downward motion of the upper piston to pressure feed the molten metal into the mold parts and subject the molten metal to continued pressure until the casting operation is completed, means for ejecting the cast article from at least one of the mold parts after casting, and the support means is an upper base plate (3), feet support the lower machine table (5) which supports a plurality of machine bearers (4) along which the upper machine table (10) is vertically displaceable, the plurality of machine bearers (4) support the upper base plate (3), adjacent an end opposite the lower machine table, to which the cylinders (7) for actuating the upper mold part (22) are mounted, and the upper machine table (10) supports, via spacing rods (12), a yoke (13) to which is mounted the upper piston cylinder (14) carrying the upper piston (18), and the yoke is vertically displaceable through an opening (15) in the upper base plate (3) during upward vertical movement of the upper machine table.

11. A device according to claim 10, wherein the mold parts (22, 24) and at least one of the upper machine table (10), the lower piston (43) and the upper piston (18) are provided with a cooling mechanism (46 and 47 respectively).

12. A device according to claim 10, wherein at least one of an inner surface of the filling chamber (20) and a surface of the lower piston (43) comprises a ceramic material which insulates and reduces wear.

13. A device according to claim 10, wherein at least one of the filling chamber (20) and a free end surface of the lower piston (43) comprises a material which heat insulates.

14. A device according to claim 13, wherein the material which heat insulates comprises a ceramic material.

15. A device according to claim 10, wherein at least a free end surface of the upper piston (18) contains a molybdenum alloy.

16. A device for die casting comprising a stationary lower machine table (5) having a stationary lower mold part (24) on an upper surface thereof, an upper mold part (22), cooperating with the lower mold part, mounted on a lower surface of an upper machine table (10), the upper mold part and the upper machine table being vertically movable relative to the lower mold part by hydraulic cylinders (7) connected to support means, the upper machine table and the upper mold part jointly forming a filling chamber (20) for receiving molten metal to be cast, a hydraulic actuated upper piston (18) attached to the support means to facilitate casting of the molten metal into the cooperating mold parts, and a hydraulic actuated lower piston (43), guided by the lower mold part, for temporarily supporting the molten metal, and the lower piston (43) cooperating with the upper piston (18) to facilitate casting of the molten metal, wherein said device further includes means for moving the lower piston (43) relative to the filling chamber to a variable initial starting position prior to supplying the molten metal to the filling chamber, the variable initial starting position of the lower piston (43) being selected so that the quantity of molten metal to be contained within the filling chamber is equivalent to a contemplated casting plus a required excess amount, means for moving an upper piston (18) into contact with a top surface of the molten metal, after supplying the molten metal to the filling chamber, without any substantial air-entrapment in the filling chamber for pressure feeding the molten metal into the mold parts (22, 24), means for jointly displacing the lower piston, the molten metal and the upper piston vertically downward until the molten metal is in communication with a feeding duct, means for stopping further downward motion of the lower piston, upon the molten metal communicating with the feeding duct, while continuing further downward motion of the upper piston to pressure feed the molten metal into the mold parts and subject the molten metal to continued pressure until the casting operation is completed, means for ejecting the cast article from at least one of the mold parts after casting, and a holding plate (27) is mounted to a lower surface of the lower machine table (5) and spaced therefrom at a desired distance by spacing rods (26), a plurality of ejector cylinders (28) are mounted on a lower surface of the holding plate and are connected, via lower ejector rods (29), to a bridge (31) mounted between the lower machine table and the holding plate for vertically displacing the bridge (31), a lower piston cylinder (38) and upper ejector rods (32) are mounted on the bridge, the upper ejector rods (32) extend through an opening in the lower machine table and support a common connection plate (34), and at least one ejector plate (35), connected to the connection plate (34), supports ejector pins (37) guided into the lower mold part (24) for ejecting the cast article.

17. A device according to claim 16, wherein at least one of an inner surface of the filling chamber (20) and a surface of the lower piston (43) comprises a ceramic material which insulates and reduces wear.

18. A device according to claim 16, wherein at least one of the filling chamber (20) and a free end surface of the lower piston (43) comprises a material which heat insulates.

19. A device according to claim 18, wherein the material which heat insulates comprises a ceramic material.

20. A device according to claim 16, wherein at least a free end surface of the upper piston (18) contains a molybdenum alloy.

* * * * *

UNITED STATES PATENT AND TRADEMARK OFFICE

CERTIFICATE OF CORRECTION

PATENT NO. : 5,188,165

DATED : February 23, 1993

INVENTOR(S) : Hans IVANSSON

It is certified that error appears in the above-identified patent and that said Letters Patent is hereby corrected as shown below:

Column 5, line 21 delete "using a ceramic coating for heat insulating-- and insert --making at least a free end surface of the upper piston heat conducting.--;

line 61 delete "the" and insert --a--.

Signed and Sealed this

Sixteenth Day of November, 1993

Bruce Lehman

*Attest:*

BRUCE LEHMAN

*Attesting Officer*

*Commissioner of Patents and Trademarks*